US011273570B2

(12) United States Patent
Hartman et al.

(10) Patent No.: US 11,273,570 B2
(45) Date of Patent: Mar. 15, 2022

(54) POUCH REGISTRATION MONITORING AND CONTROL SYSTEM

(71) Applicant: Mespack Cloud, LLC, Des Plaines, IL (US)

(72) Inventors: Donn D. Hartman, Hawthorn Woods, IL (US); Tony Loiacono, Schamburg, IL (US); Russell J. Miller, Des Plaines, IL (US); Alexander J. Waterman, Mount Prospect, IL (US)

(73) Assignee: Mespack Cloud, LLC, Des Plaines, IL (US)

( * ) Notice: Subject to any disclaimer, the term of this patent is extended or adjusted under 35 U.S.C. 154(b) by 42 days.

(21) Appl. No.: 16/422,436

(22) Filed: May 24, 2019

(65) Prior Publication Data

US 2019/0358843 A1 Nov. 28, 2019

Related U.S. Application Data

(60) Provisional application No. 62/676,442, filed on May 25, 2018.

(51) Int. Cl.
*B26D 5/00* (2006.01)
*B26D 7/06* (2006.01)
(Continued)

(52) U.S. Cl.
CPC ..... *B26D 7/0625* (2013.01); *B26D 5/007* (2013.01); *B65B 9/087* (2013.01); *B65B 43/02* (2013.01); *B65B 61/08* (2013.01)

(58) Field of Classification Search
CPC ..... B26D 5/32; B26D 1/405; B65B 9/087; B65B 61/08
(Continued)

(56) References Cited

U.S. PATENT DOCUMENTS

RE30,628 E * 5/1981 Tokuno ..... B23D 36/005 318/600
4,519,868 A * 5/1985 Hoffmann ..... B65C 9/44 156/353
(Continued)

FOREIGN PATENT DOCUMENTS

EP 0577842 * 12/1994 ..... D06H 7/00

*Primary Examiner* — Kenneth E Peterson
(74) *Attorney, Agent, or Firm* — Leydig, Voit & Mayer, Ltd.

(57) ABSTRACT

A system for controlling registration on a pouch knife machine of a longitudinally extending bandolier of content containing pouches separated by transverse seal seams moving along a feed path, with each pouch having a measurement reference. The machine includes a knife mechanism, a friction drag mechanism, and a friction drag adjustment mechanism. The system includes an optical reference, an optical image sensor, and a controller. The controller is configured to determine an actual position of the measurement reference relative to an optical reference, determine an alignment input based upon the actual position of the measurement reference relative to the optical reference, determine an alignment difference between a target position and the alignment input, and generate an adjustment command to change the position of the bandolier along the feed path after the alignment difference exceeds the operating range for the target position.

14 Claims, 11 Drawing Sheets

(51) Int. Cl.
*B65B 43/02* (2006.01)
*B65B 61/08* (2006.01)
*B65B 9/087* (2012.01)

(58) Field of Classification Search
USPC ..... 83/371
See application file for complete search history.

(56) References Cited

U.S. PATENT DOCUMENTS

| | | | | | |
|---|---|---|---|---|---|
| 4,781,090 | A * | 11/1988 | Feldkamper | B26D 5/32 | 83/312 |
| 5,045,135 | A * | 9/1991 | Meissner | B26D 5/32 | 156/64 |
| 5,222,422 | A | 6/1993 | Benner et al. | | |
| 5,286,317 | A * | 2/1994 | Treat | B26D 5/20 | 156/248 |
| 5,359,832 | A | 11/1994 | Hartman et al. | | |
| 5,777,879 | A * | 7/1998 | Sommerfeldt | B26D 5/32 | 226/27 |
| 5,937,748 | A * | 8/1999 | Leligdon | B41F 13/025 | 101/248 |
| 7,047,852 | B2 * | 5/2006 | Franklin | A61F 13/15593 | 101/181 |
| 9,073,230 | B2 * | 7/2015 | Umebayashi | A61F 13/15739 | |
| 2005/0039417 | A1 | 2/2005 | Liedtke et al. | | |
| 2009/0288367 | A1 | 11/2009 | Granili et al. | | |
| 2012/0055297 | A1 * | 3/2012 | Pedercini | B65H 23/1882 | 83/13 |
| 2017/0259447 | A1 * | 9/2017 | Takatsu | B26F 1/02 | |

* cited by examiner

POUCH REGISTRATION MONITORING AND CONTROL SYSTEM

RELATED APPLICATIONS

This patent application claims the benefit of U.S. Patent Application No. 62/676,442, filed May 25, 2018, which is incorporated by reference.

BACKGROUND

This disclosure relates to production of product containing pouches employing horizontal form, fill and seal packaging machinery such as illustrated, for example, in U.S. Pat. No. 5,699,653, which is incorporated by reference. Typically, the output of such a machine comprises a bandolier of filled pouches connected along a common side seam seal. The bandolier is processed on a remote knife mechanism for separation into individual pouch products.

Remote knife mechanisms are well known and widely used. An aspect of operating such equipment is the need to maintain proper registration between the travelling bandolier of pouches and the cutting blades of the knife mechanism. In an embodiment, this function is manual and subject to the frailties of operator intervention.

SUMMARY

The system of the present disclosure provides automatic registration control. It utilizes optical monitoring indicative of the positional relationship between the bandolier and the cutting elements. Recognition of a deviation generates an output signal delivered to mechanism responsive to adjust the input flow of pouches relative to the cutting elements. The system includes electronic sensing, with image capture, data processing with a programmable controller (PLC), output signal generation and mechanical adjustment, through responsive mechanism.

In an aspect, a system for controlling registration on a pouch knife machine, of a longitudinally extending bandolier of content containing pouches separated by transverse seal seams moving along a feed path, with each pouch having a measurement reference. The machine includes a knife mechanism, a friction drag mechanism, and a friction drag adjustment mechanism. The knife mechanism includes a major knife hub mounted along the feed path and having a plurality of spaced apart blades having an outer edge, a minor knife hub having at least one blade, with the minor knife hub cooperating with the major knife hub to sever individual pouches from the bandolier at the seal seams, and the drive mechanism drives the major knife hub and the minor knife hub in a synchronous manner. The system includes an optical reference, an optical image sensor, and a controller. The optical reference is indicative of the location of cooperation between said blades of said major knife hub and minor knife hub and the optical image sensor generates position signals indicative of a position relative to the optical reference of the measurement references of moving pouches along the feed path. The controller is configured to store a target position for the measurement reference relative to the optical reference indicative of a desired cutting location within a pouch seal seam, store an operating range for the target position, receive position signals from the optical image sensor, and determine an actual position of the measurement reference relative to the optical reference based upon the position signals. The controller is further configured to determine an alignment input based upon the actual position of the measurement reference relative to the optical reference, determine an alignment difference between the target position and the alignment input, and generate an adjustment command to change the position of the bandolier along the feed path after the alignment difference exceeds the operating range for the target position.

In another aspect, a method of controlling registration on a pouch knife machine of a longitudinally extending bandolier of content containing pouches separated by transverse seal seams moving along a feed path with each pouch having a measurement reference includes maintaining driving engagement between a major knife hub and the bandolier along the feed path, storing a target position for the measurement reference relative to an optical reference of an optical image sensor disposed along the feed path, with the target position corresponding to a cutting location of the major knife hub and a minor knife hub that interacts with the major knife hub to sever pouches from the bandolier, and storing an operating range for the target position. The method further includes receiving position signals from the optical image sensor, determining an actual position of the measurement reference relative to the optical reference based upon the position signals, determining an alignment input based upon the actual position of the measurement reference relative to the optical reference, determining an alignment difference between the target position and the alignment input, and generating an adjustment command to adjust a position of the bandolier along the feed path after the alignment difference exceeds the operating range for the target position.

BRIEF DESCRIPTION OF THE DRAWINGS

The present disclosure is illustrated by way of example and is not limited in the accompanying figures in which like reference numerals indicate similar elements and in which.

DETAILED DESCRIPTION

Figure 1:
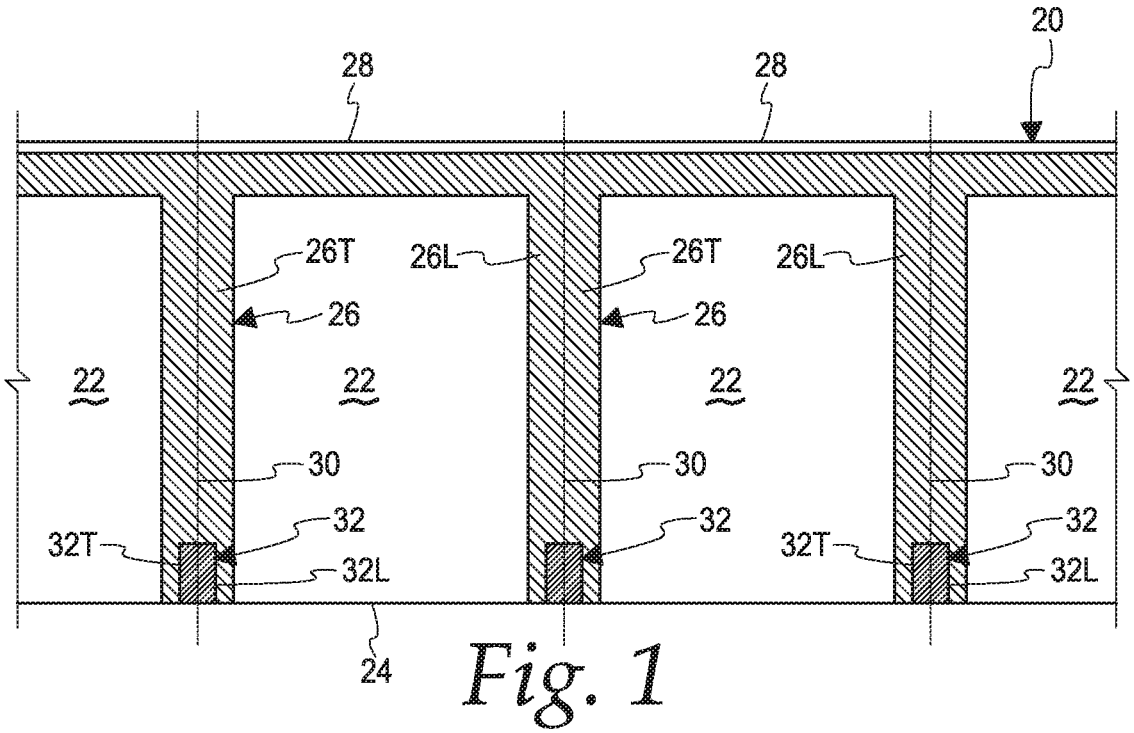
FIG. 1 depicts a schematic view of a portion of a bandolier of pouches that may be used with the systems disclosed herein.

FIG. 1 is a graphic representation of a bandolier, generally designated 20, illustrative of product containing pouches 22 representing the output of a horizontal form, fill and seal packaging machine (not shown). These pouches are formed of a polymeric film or foil material, folded over along a bottom edge 24. Such pouches may be filled with powder, particulate material, liquid or any product suitable to distribution in sealed packets.

The packaging machine creates spaced side seam seals 26 and temporarily creates a fill opening to the interior of the pouch along top edge 28. After filling the pouch, the top horizontal edge is sealed, closing the fill opening and sealing the pouch.

The remote cutting mechanism 10 of this disclosure, discussed in detail below, forms side edges 30 of each pouch 22 and, in doing so, separates the bandolier 20 of pouches through the common side seam seal 26 to form the individual pouches 22. As described in more detail below, interacting blades of the knife mechanism 10 form the pouch side edges 30 of adjacent pouches optimally by bisecting the connecting side seam seal 26 to form leading side seam seal 26L and trailing side seam seal 26T.

The terms "leading" and "trailing," "forward" and "rearward," "advanced" and "retarded," as used herein, are in reference to the direction of travel of bandolier 20 (depicted by arrow "A"), as is the term "longitudinal." "Wider" and "narrower" and "width" refer to a dimension along the longitudinal extent of pouch 22 between side edges 30 of the bandolier 20.

In the pouch-forming process, the pouch material is usually printed with product indicia and other information. As illustrated in this disclosure, registration marks or "eyemarks" 32 may be printed in spaced intervals to identify the appropriate location for forming side edges 30. In the drawings, registration marks 32 include leading edge 32L and trailing edge 32T.

Figure 3:
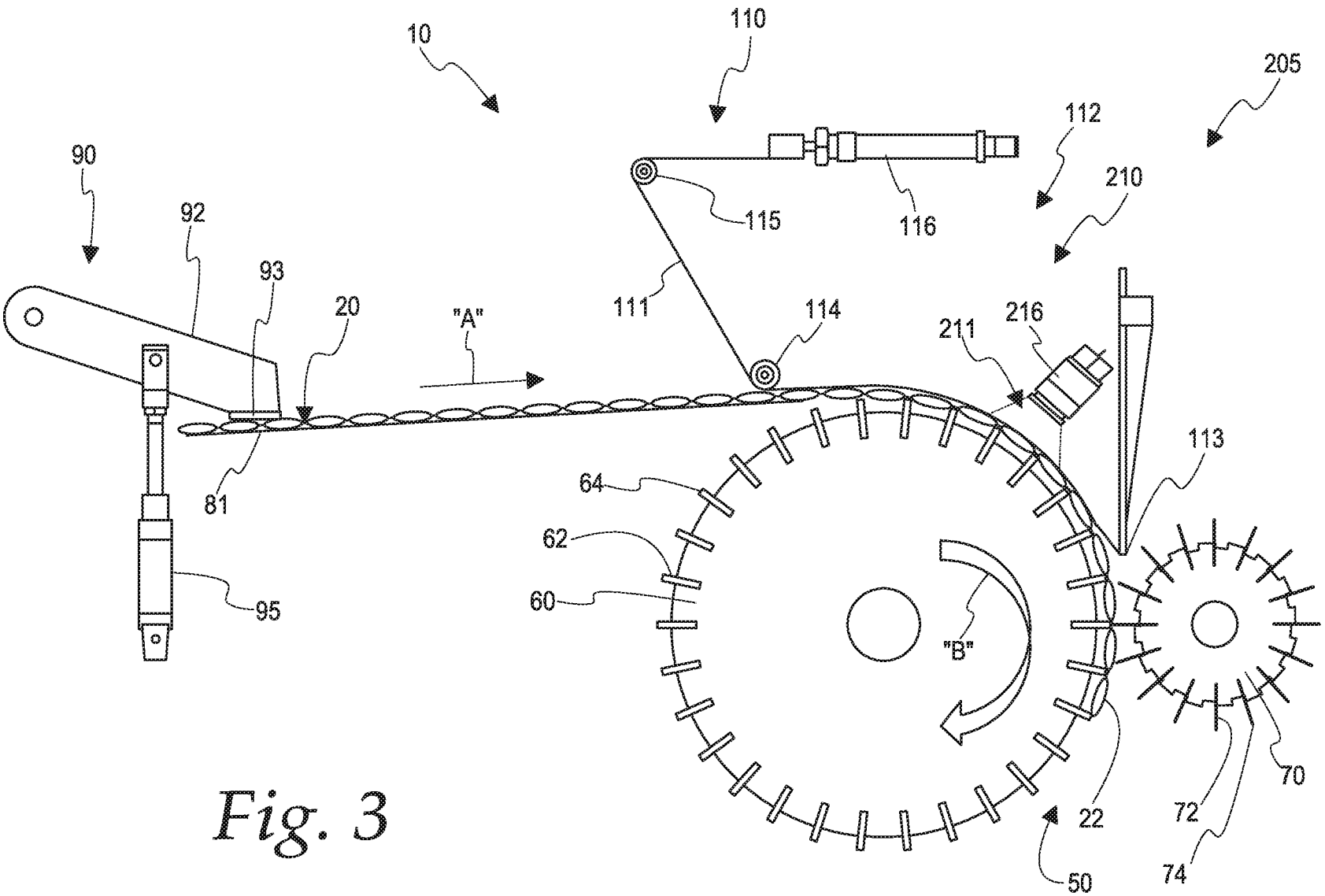
FIG. 3 depicts a schematic view of a remote cutting mechanism according to the present disclosure.
Figure 4:
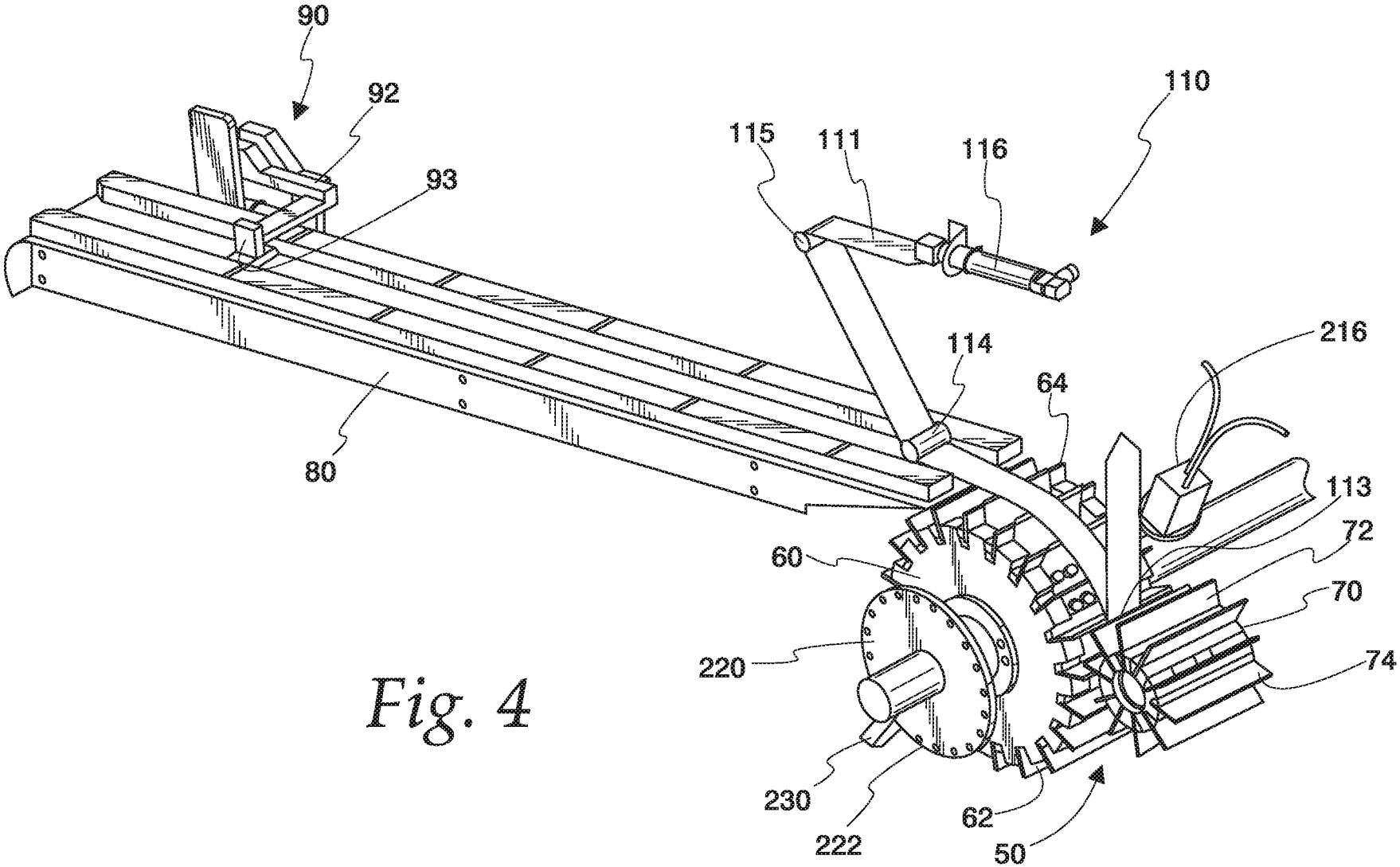
FIG. 4 depicts a perspective view of the remote cutting mechanism of FIG. 3.
Figure 5:
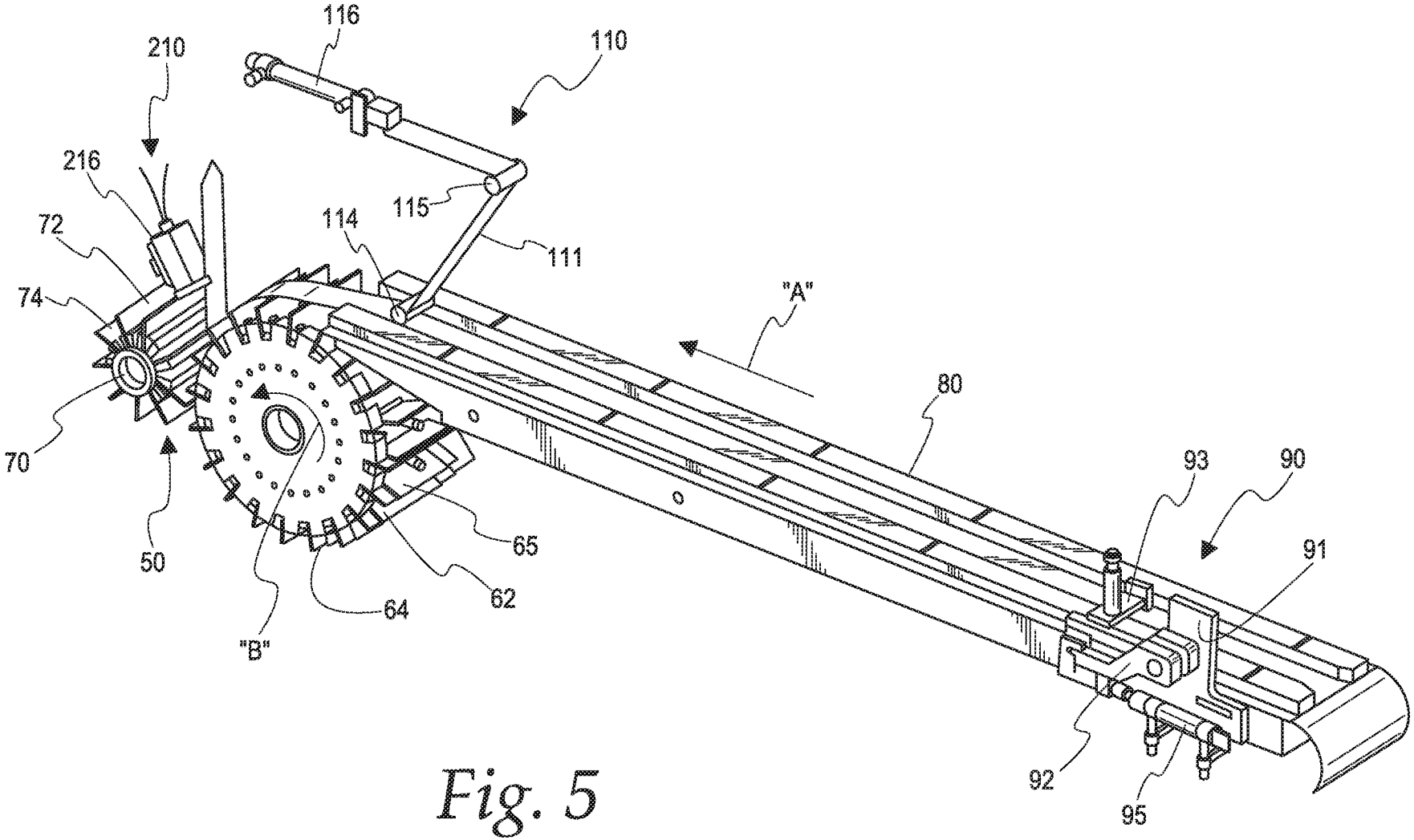
FIG. 5 depicts a perspective view similar to FIG. 4 but from an opposite orientation.
Figure 6:
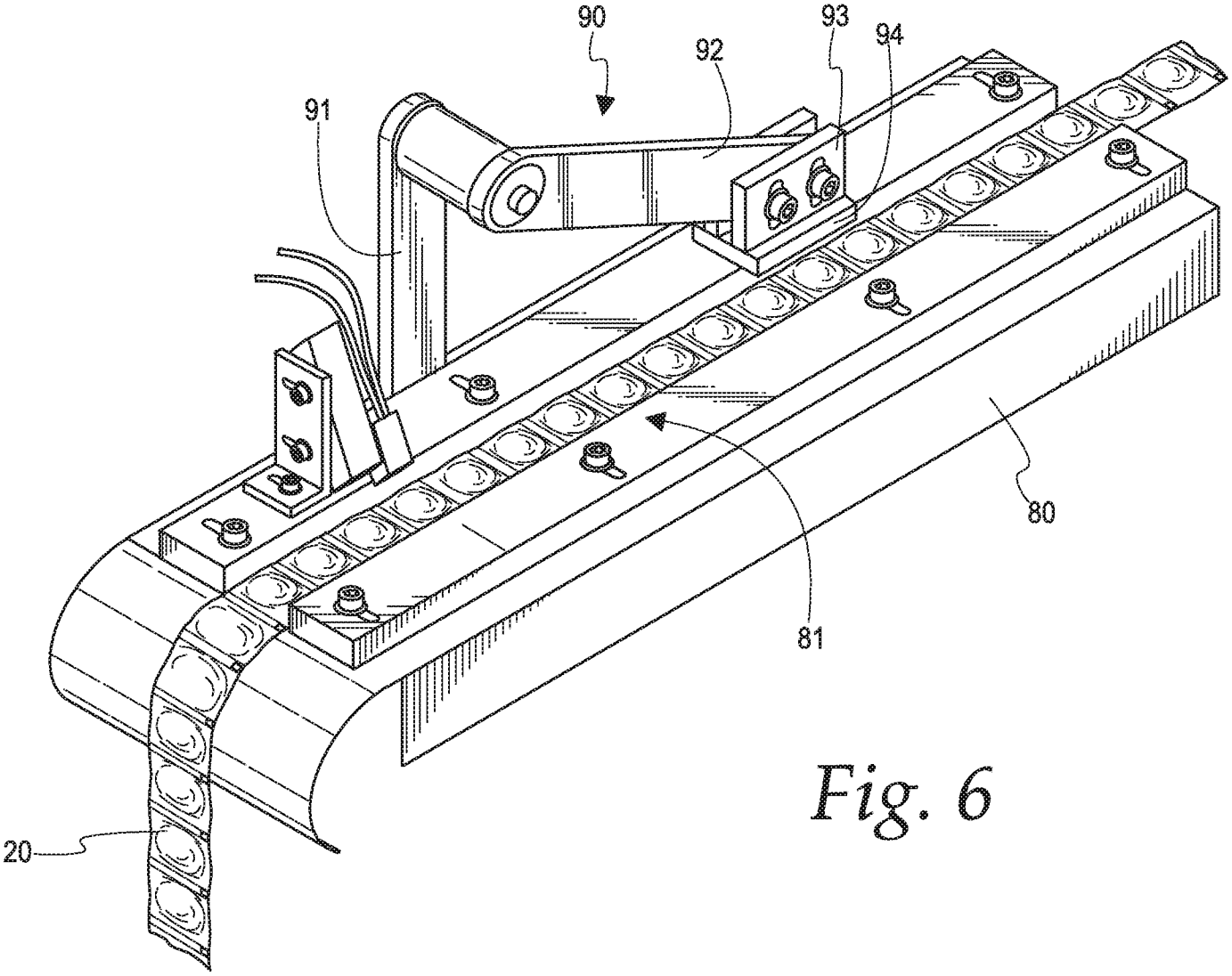
FIG. 6 depicts an enlarged perspective view of the feed path of the bandolier of pouches with a paddle tensioning device raised above the bandolier for clarity.
Figure 7:
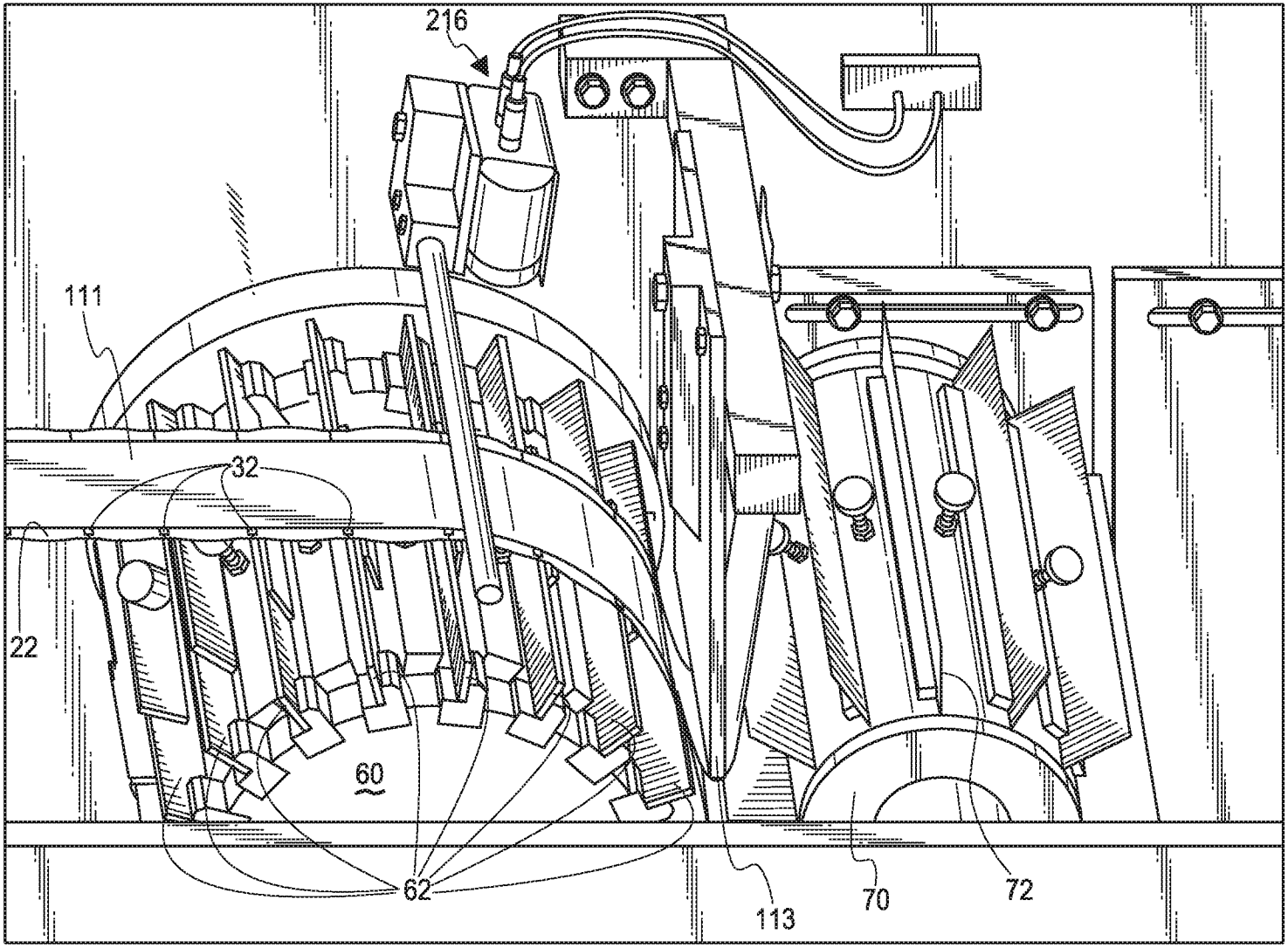
FIG. 7 depicts an enlarged perspective view of the major knife hub, the minor knife hub, and the optical image sensor.

The knife mechanism, generally 50, is graphically illustrated in FIGS. 3, 4 and 5. FIG. 6 shows the delivery of a pouch bandolier 22 along a feed path 81 of the entry ramp 80 to the knife mechanism 50 for processing. The knife mechanism 50 includes powered major knife hub 60 and minor knife hub 70 that coact to sever individual pouches from the bandolier 20. An entry ramp 80 defines a pouch channel or feed path to provide sliding support of the bandolier 20 as it travels to the coacting knife hubs.

Figure 9:
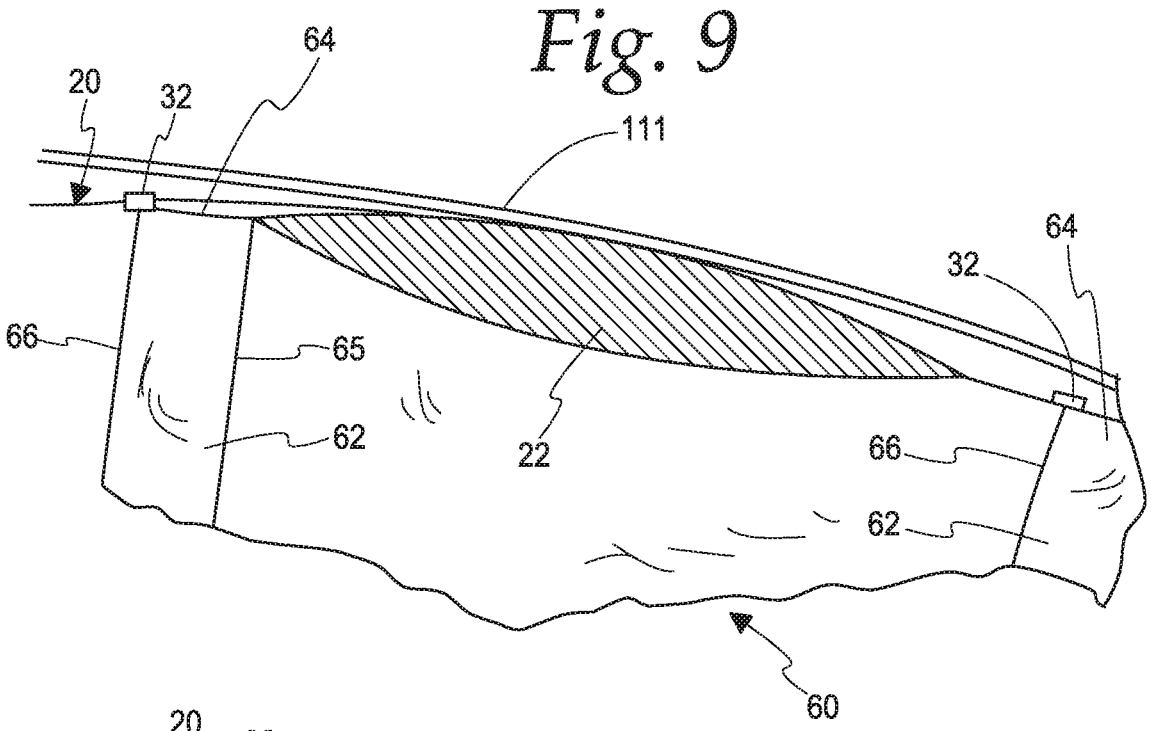
FIG. 9 depicts an enlarged cross-section of one of the pouches disposed between adjacent radial blades of the major knife hub and the belt of the belt tensioning device.
Figure 10:
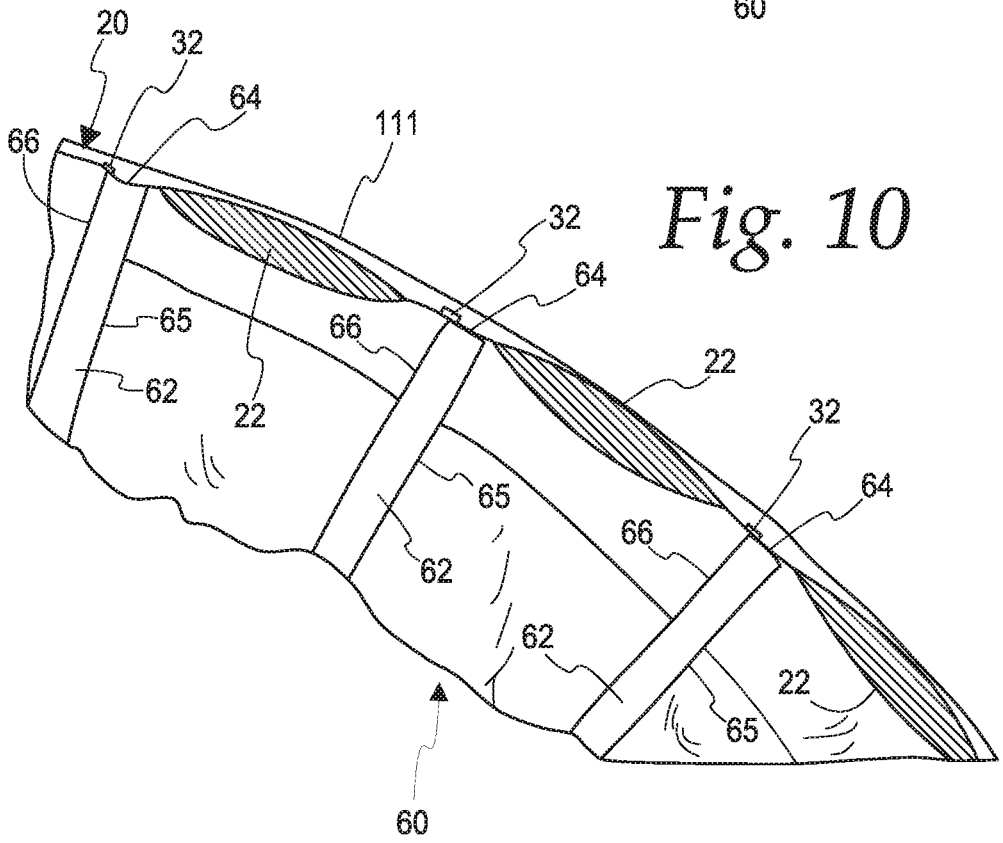
FIG. 10 depicts a cross-section of a plurality of pouches disposed between radial blades of the major knife hub and the belt of the belt tensioning device.

Referring to knife mechanism 50, the major knife hub 60 is segmented into a plurality of stations by radial blades 62. As best seen in FIGS. 9 and 10, blades 62 include radially outer edges or lands 64 defining the outer perimeter of major knife hub 60. It should be noted that the outer edges 64 of the major hub blades 62 are not sufficiently sharp so as to cut the bandolier 20 without the interaction of the minor knife hub 70 as described below but rather operate to engage and carry the bandolier as also described in further detail below. The direction of rotation of the major knife hub 60 is depicted by an arrow "B." Each radial blade 62 includes a leading radial edge surface 65 as well as a trailing radial edge surface 66 as discussed further below. (See FIGS. 9 and 10). The pouch bandolier 20 overlies and contacts the radial outer edges 64 of blades 62 of major knife hub 60 along a length of the major knife hub.

The minor knife hub 70 can include a lesser number of the radial blades 72 than major knife hub 60. Each blade 72 includes a radial outer cutting edge 74 that coacts, in shear, against a trailing radial edge surface 66 of one of the blades 62 of the major blade hub 60 to create the side edges 30 on each pouch by severing the common side seam seal 26 to form the trailing side seam seal 26T of one pouch 22 and the leading side seam seal 26L of the subsequent pouch 22. More specifically, the cutting edge 74 of one of the radial blades 72 of the minor knife hub 70 interacts with the trailing radial edge surface 66 of one of the radial blade 62 of the major blade hub 60 to cut one of the common side seal seams 26 between adjacent pouches 22. In doing so, each cutting operation creates a leading side seam seal 26L and a trailing side seam seal 26T of adjacent pouches 22 from the bandolier 20. The hubs 60 and 70 are positioned relative to each other and driven by a drive mechanism synchronously to coact such that the minor hub blades 72 sever pouches 22 from the bandolier 20 in a scissor-like fashion.

From the foregoing, it may be understood that the radial blades 62 of the major knife hub 60 serve two purposes. First, the outer edges 64 operate to carry or pull the bandolier 20 of pouches 22 from the bandolier supply, along the feed path 81, and to the major knife hub 60. Second, the trailing radial edge surfaces 66 of the radial blades 62 of the major knife hub 60 cooperate with the cutting edges 74 of the radial blades 72 of the minor knife hub 70 to sever the pouches 72 from the bandolier 20.

Powered rotation of the major knife hub 60 advances the bandolier 20 along the pouch channel or feed path 81 on a line tangent to the major knife hub 60 at radial outer edges 64 of blades 60. More specifically, in the illustrated remote knife mechanism 10, a strap tensioning device 110 (FIGS. 3-5) is instrumental in maintaining the driving relationship between the blade edges 64 of major knife hub 60 and the pouch bandolier 20. The strap tensioning device 110 provides a force radially inward on the bandolier 20 towards the edges 64 of the major hub blades 62 to maintain the pouch bandolier 20 in driving contact with the blade edges 64. As a result of the strap tensioning device 110 pressing the bandolier 20 against the outer edges 64 of the major hub blades 62, rotation of the major hub 60 in the direction depicted by arrow "B" pulls or drives the bandolier 20 along the feed path 81 in the direction depicted by arrow "A."

As best seen in FIGS. 9 and 10, the generally oval longitudinal cross-section of the filled pouches 22 causes the pouches to assume a position nested between adjacent major hub blades 62. In the depicted embodiment, the registration marks 32 are used to identify the desired location when forming the common side seam seal 26 that is subsequently split to form the side edges 30 of adjacent pouches 22.

The remote knife mechanism 10 further utilizes the registration marks 32 to dynamically adjust the location at which the common side seam seal 26 is cut. To do so, the bandolier is positioned relative to the major hub 60 so that a registration mark 32 generally overlies the edge or land 64 of one of the major hub blades 62. Ideally, as an optimum position to be achieved with the system of this disclosure, the trailing radial edge surface 66 is positioned to bisect the registration mark 32. For simplification of the explanation, it has been assumed that each registration mark is printed on the bandolier 20 in a position in which the desired aligned cut would bisect the registration mark.

It is understood that the registration mark could be printed in a repetitious pattern anywhere on the pouch. For example, the registration marks 32 may be printed anywhere on the bandolier 20 provided that they can be monitored by the optical image sensor 216 as described below. In the depicted embodiment, the registration marks 32 are depicted as rectangles located along the bottom edge 24 of the bandolier and ideally centered within the common side seam seal 26. In another embodiment, other indicia such as logos, writing, or other printed shapes, regardless of position on the bandolier 20, may be used as the registration marks provided that they are included in a repeating pattern on or associated with each pouch 22.

Various parameters of pouch making affect the minimum force required to maintain the driving relationship between the bandolier 20 and the outer edges 64 of the major hub blades 62. These include the pouch material, the pouch configuration, the contents of the pouch, manufacturing tolerances, environmental conditions, and other factors. The impact of these parameters are well known and accommodated by appropriate setting of the radial forces controlling advancement of the bandolier 20.

Advancement or driving of the bandolier 20 results from frictional contact between the surface of bandolier 20 at the side seam seals 26 and the edges 64 of the rotating blades 62 of the major knife hub 60. Inherent in this relationship is a degree of rearward slip (counter-clockwise as compared to arrow "B" In FIG. 3, clockwise in FIG. 5) of the bandolier 20 relative to the blade edges 64. This slippage may be 1/64" (inch) to 1/32" (inch) or more per pouch. Consequently, the edges 64 of blades 62 are spaced apart based upon a chord length equal to the width of an ideally filled pouch 22. In other words, the distance between the outer edges 64 of adjacent major hub blades 62 is equal to the distance between the side edges 30 of a pouch 22 that has been filled to an ideal extent.

It will be understood by one skilled in the art that the width or distance between the side edges 30 of a pouch that is over-filled will be less than the width of an ideally filled pouch and the width or distance between the side edges 30 of a pouch 22 that is under-filled will be greater than the width of an ideally filled pouch. Reliable control of the slippage is an important element of the operation of the remote knife mechanism 10.

Longitudinal positioning of the travelling bandolier 20 relative to the major hub 60 and minor hub 70 to ensure uniform side seam seals 26T, 26L (resulting from cutting at the center of the common side seals 26) is controlled through application of a combination of frictional drag forces upon the exterior surface of the travelling bandolier of pouches 22.

Modification or adjustment of the frictional drag on the travelling bandolier 20 of pouches can be imparted by any suitable device. For example, a roller (not shown) with adjustable frictional resistance could be positioned in rolling contact with the exposed upper surface of the travelling bandolier. A mechanism could be employed to adjust the rotational resistance in accordance with the amount of pouch "slippage" desired or necessary. Such a roller can be made of rubber or similar material to prevent damage to the pouches. Another option contemplated could include a timing belt configuration (not shown) in resistive contact with the travelling bandolier 20, again, arranged to adjust the drag imposed, based on recognized alignment requirements.

In the depicted embodiment, two separate components for controlling slippage or drag are employed. Referring to FIG. 3, a paddle device 90 is associated with the entry ramp 80. The second is the belt tensioning device 110 associated with the major knife hub 60. In some embodiments, the paddle device 90 may be omitted.

The illustrated paddle tensioning device 90 includes a support leg 91, a cantilevered arm 92 pivotably mounted on the support leg, and a paddle 93 with a flat surface 94. The paddle 93 can be pivotably mounted on the support leg 91 so that the flat surface 94 faces and engages the bandolier 20 as it moves along the feed path 81 to exert a force perpendicular to the bandolier.

The paddle tensioning device 90 further includes an actuator 95, such as a pneumatic actuator, that is operative to adjust the amount of pressure exerted on the bandolier 20 by the surface 94 of the paddle 93. The paddle tensioning device 90 may be configured so that a linear relationship exists between the force imparted by paddle device 90 and the resulting position of the cut of the side edges 30 in relation to the eyemark or registration mark 32. In other words, linearly increasing or decreasing the force imparted by the paddle tensioning device 90 will result in a linear increase or decrease in the relative position of the location of the edges 30 relative to the registration mark 32.

The illustrated belt tensioning device 110 includes a flexible belt or strap 111 and a belt guide system 112 operative to position the belt adjacent the bandolier to exert an adjustable radial force (i.e., perpendicular to the bandolier 20) on the outer surface of the bandolier 20 at a portion of the perimeter of the major knife hub 60 defined by the blade edges 64. As depicted, the belt guide system 112 includes a lower guide 113, a first roller 114 disposed along the feed path 81 configured to engage the bandolier 20 upstream from the major knife hub and a second roller 115 spaced from the feed path.

The belt tensioning device 110 further includes an actuator 116, such as a pneumatic actuator, that is operative to adjust the amount of pressure exerted on the bandolier 20 by the belt 111. As with the paddle tensioning device 90, the belt tensioning device 110 may be configured so that a linear relationship exists between the force imparted by the belt 111 and the resulting position of the cut forming the side edges 30 in relation to the eyemark or registration mark 32. In doing so, linearly increasing or decreasing the force imparted by the belt tensioning device 110 will result in a linear increase or decrease in the relative position of the location of the side edges 30 relative to the registration mark 32.

In some known arrangements, the paddle tensioning device 90 and the strap tensioning device 110 are associated with manually adjustable mechanisms, such as a spring or air cylinder. The amount of force that can be imparted to the travelling bandolier 20 through manual adjustment of these mechanisms is based on observations of the finished pouches by a machine operator.

The operation of the remote cutting mechanism 10 may be controlled by a control system depicted generally at 200. The control system 200 may include an electronic control module or controller 201 and a plurality of sensors associated with the remote cutting mechanism 10 that provide data and input signals representative of various operating parameters of the remote cutting mechanism 10. The control system 200 may operate by using the data from the various sensors as discussed in further detail below.

The controller 201 may be an electronic controller that operates in a logical fashion to perform operations, execute control algorithms, store and retrieve data and other desired operations. The controller 201 may include or access memory, secondary storage devices, processors, and any other components for running an application. The memory and secondary storage devices may be in the form of read-only memory (ROM) or random access memory (RAM) or integrated circuitry that is accessible by the controller. Various other circuits may be associated with the controller 201 such as power supply circuitry, signal conditioning circuitry, driver circuitry, and other types of circuitry.

The controller 201 may be a single controller or may include more than one controller disposed to control various functions and/or features of the remote cutting mechanism 10. The term "controller" is meant to be used in its broadest sense to include one or more controllers and/or microprocessors that may be associated with the remote cutting mechanism 10 and that may cooperate in controlling various functions and operations of the mechanism. The functionality of the controller 201 may be implemented in hardware and/or software without regard to the functionality. The controller 201 may rely on one or more data maps that may be stored in the memory of controller. Each of these data maps may include a collection of data in the form of tables, graphs, and/or equations.

The control system 200 and controller 201 may be located at the remote cutting mechanism 10 or may be distributed with components also located remotely from the remote cutting mechanism. The functionality of control system 200 may be distributed so that certain functions are performed at the first machine 11 and other functions are performed remotely.

As stated above, the remote cutting mechanism 10 may be equipped with a plurality of systems and sensors that provide data indicative (directly or indirectly) of various operating parameters of the mechanism. The term "sensor" is meant to be used in its broadest sense to include one or more sensors and related components that may be associated with the remote cutting mechanism 10 and that may cooperate to sense various functions, operations, and operating characteristics of the mechanism.

The control system 200 further includes a registration monitoring and control system generally indicated at 205 that provides automatic adjustment of pouch registration relative to the radial blades 62 of the major knife hub 60. The registration monitoring and control system 205 utilizes an optical image capture system 210 to acquire data indicative of the position of the registration mark 32 as the registration mark approaches the minor knife hub 70. The controller 201 is operative to control the relationship between the position or registration of the bandolier 20 and the knife mechanism 50.

The controller 201 is further operative to determine whether the position of the registration mark 32 varies from the desired position by more than an operating threshold. If the distance between the registration mark in the desired position exceeds the operating threshold, the controller 201 is configured to generate an adjustment command to modify the force on the bandolier 20 and thus alter the relationship between the registration mark 32 and the desired position. Notably, the deviation recognized by the vision signal acquisition may also be employed to effect shutdown of the remote knife mechanism 10 based on recognition of an excessive deviation.

The controller 201 can include a monitor and keyboard 204 (FIG. 8) to receive operator input settings. Such settings can include a desired or target position which represents a numerical scale value (e.g., 0-20) indicative of a desired position of a measurement edge (e.g., the trailing edge 32T or leading edge 32L) or other reference of the registration mark 32. This value is the "zero" or optimal numerical reference that will result in the knife mechanism 50 cutting the common side seam seals 26 at the center thereof to form the leading side seam seal 26L and the trailing side seam seal 26T having equal widths.

Another input setting may be a "dead band" or operating range within which no adjustment directive will be initiated. More specifically, deviation from the desired or target position is to be expected and no adjustment to the tension on the bandolier 20 is made provided that the actual position of the measured edge of the registration mark 32 is within the operating range or threshold. This operating range minimizes hysteresis or oscillation of the adjustment function.

A further input setting may be a specified adjustment amount that designates the magnitude of change initiated, should a deviation be recognized that requires repositioning of the bandolier 20 relative to the rotary blades 62 and 72 by the actuators 95 and 116. In some instances, such adjustments are made in one pound per square inch increments (PSI). Still a further input setting may designate when to adjust the force applied by the paddle tensioning device 90 to change the slippage of the bandolier 20 and/or when to adjust the force applied by the belt tensioning device 110 to change the slippage of the bandolier. Each of the input settings can be set or stored within the controller 201 or accessed by the controller from a remote source.

Deviations from alignment are determined and evaluated by the controller 201. It is the deviation of formation of edge 30 relative to registration mark 32 that dictates modification of the amount (and direction) of slippage of bandolier 20 necessary to properly position the bandolier 20 relative to the major knife hub 60.

The control system 200 includes an optical image capture system 210 for determining the position of the pouches 22 of the bandolier 20 relative to a pre-established reference scale location. More specifically, the optical image capture system 210 can include any type of optical image sensor 216, such as one or more cameras, configured to generate optical image data indicative of the position of the bandolier 20. A reference scale 212 (FIG. 11) is associated or overlayed with the optical image data and used to determine whether the registration marks 32 are aligned with the desired or target position in order to determine whether to adjust the resistance to movement of the travelling bandolier 20 imparted by the paddle tensioning device 90 and/or the belt tensioning device 110.

Figure 8:
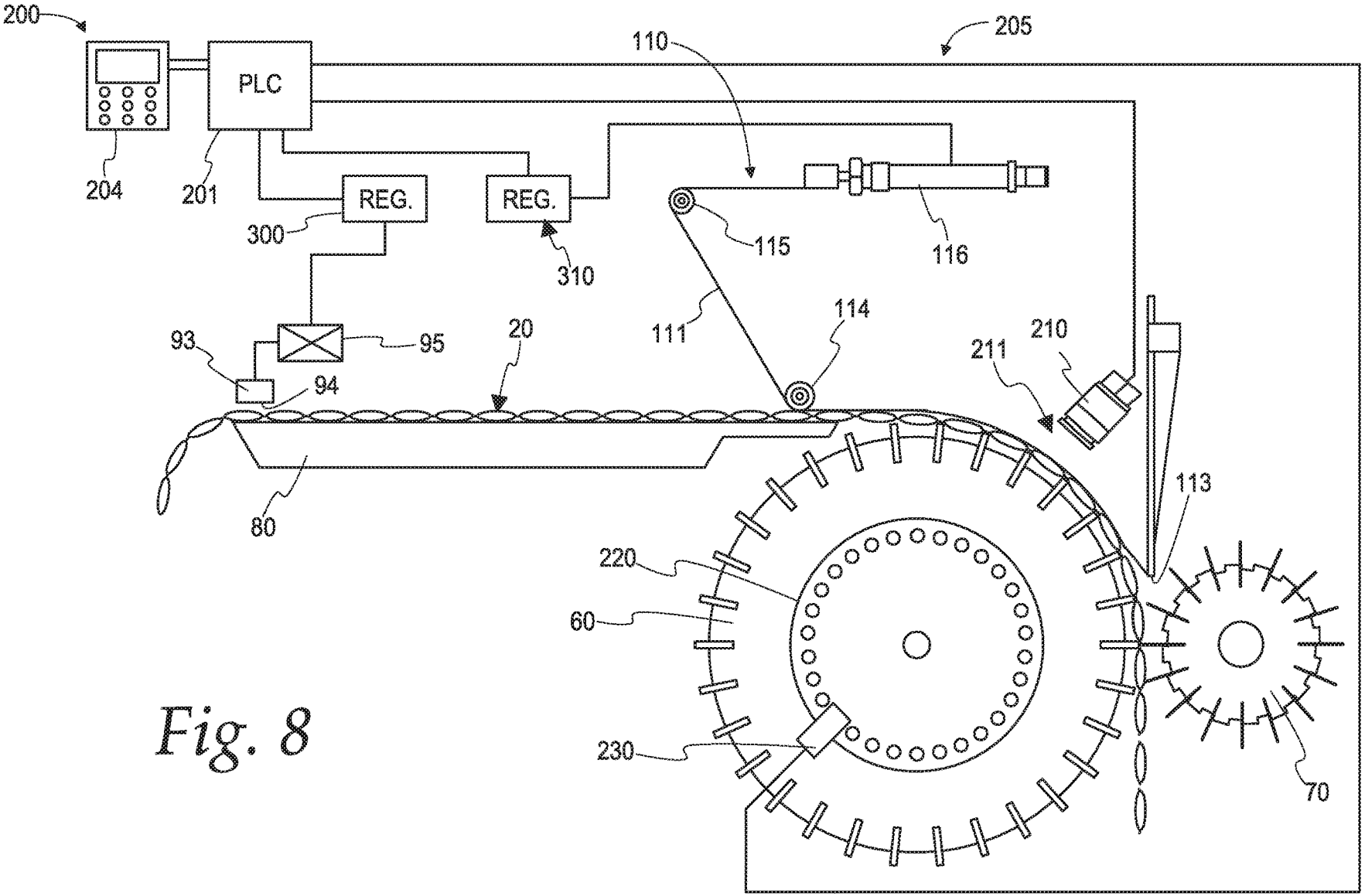
FIG. 8 depicts a schematic view similar to FIG. 3 but further including certain components of the control system.

The optical image sensor 216 is actuated by a position recognition mechanism comprising a trigger disc 220 and a trigger sensor 230, seen in FIG. 4 and graphically depicted on FIG. 8. The position recognition mechanism functions as a signal generator to identify when the optical image sensor 216 captures image data indicative of the position of the reference mark 32. The trigger disc 220 is mounted for rotation with the major knife hub 60 and includes a plurality of apertures 222 disposed about a circular pattern near the outer perimeter of the disc 220. In an embodiment, the major knife hub 60 and the disc 220 can include an equal number of knife blades 62 and apertures 222. In another embodiment, the number of apertures 222 could be less than the number of knife blades 62 and the registration monitoring and control system 205 configured so that it does not capture the image of every registration mark 32.

The trigger sensor 230 views the path of the apertures 222 in the rotating disc 220 and generates a signal as each aperture is recognized. This signal initiates the function of the optical image sensor 216 in a periodic pattern corresponding to each registration mark 32 becoming aligned with the image acquisition field 211 (FIG. 11) of the optical image sensor. Other manners of triggering the optical image sensor 216 are contemplated. For example, the trigger sensor 230 could be triggered by movement of the major hub blades 62 and the trigger disc 220 omitted.

As seen in the drawings, particularly FIG. 3 or 8 in the arrangement disclosed, image acquisition occurs at a location depicting the travelling bandolier 20 and edges 64 of blades 62 in driving engagement. This image acquisition field, generally depicted at 211 in the drawings, may be upstream of the area of interaction between the blades 62 of the major knife hub 60 and blades 72 of the minor knife hub 70, where cutting of the side seams 30 occurs. The image acquisitions field 211 may be referenced to as the sensing area or zone. The area or zone in which the blades 62 of the major knife hub 60 interact with the blades 72 of the minor knife hub maybe referred to as the cutting area or zone.

In an embodiment, the optical image sensor 216 can be configured as a "smart camera." That is, it can have data processing capability to convert the acquired images to an absolute numerical function for delivery to the controller 201. In such a configuration, the optical image sensor 216 includes the capability to provide an internal reference scale, generally designated 212 in FIG. 11. In an embodiment, a reference or target position of a measurement edge (e.g., the trailing edge 32T or leading edge 32L) or other reference of the registration mark 32 is associated with the knife mechanism 50 when cutting the common side seam seals 26 at a center location so that the leading side seam seal 26L and the trailing side seam seal 26T of adjacent pouches 22 have equal widths. This association may be performed during a set up process of the remote knife mechanism 10. It will be understood by those skilled in the art that regardless of the form of the registration mark 32 and whether the registration mark is centered on the desired cut location, a portion or measurement edge of the registration mark 32 is associated with a desired cut location during the setup process.

The reference or target position of the measurement edge of the registration mark 32 may then be associated with a numerical value corresponding to a location on the reference scale 212. In doing so, the location of the reference scale 212 can be adjusted, internally of the optical image sensor 216, relative to the reference or target position of the measurement edge of the registration mark 32 at the instant the optical sensor acquires an image (as triggered by trigger disc 220 and trigger sensor 230). For example, in some embodiments, it may be desirable to position the reference or target position of the measurement edge of the registration mark 32 at the center of the reference scale 212. In another embodiment, as depicted in FIG. 11, it may be desirable to position the registration mark 32 so that it is centered relative to the reference scale 212.

In operation, upon triggering the optical image sensor 216, optical image data from the optical image sensor is delivered to controller 201. The controller 201 can determine whether the measurement edge of the registration mark 32 is within the dead band or operating range surrounding the reference or target position on the reference scale 212. If the measurement edge of the registration mark is within the operating range, the remote knife mechanism 10 may continue to operate without change as the pouches 22 are separated from the bandolier 20. If the measurement edge of the registration mark 32 is outside the operating range, the controller 201 can generate an adjustment command so that one or both of the paddle tensioning device 90 and the belt tensioning device 110 can be adjusted to control the slippage of the bandolier 20 and thus adjust the location at which the knife mechanism 50 cuts the bandolier to separate the pouches.

If desired, after generating an adjustment command, the controller 201 may be configured to enter a dwell or sleep mode with respect to further adjustments of the slippage of the bandolier 20 for some period of time or number of pouches 22 that are processed. With such a configuration, immediately after generating an adjustment command, the registration monitoring and control system 205 will not make or generate additional adjustment commands for some period of time. More specifically, after generating an adjustment command, the controller 201 is operative to make the corresponding adjustment to either or both of the paddle tensioning device 90 and the belt tensioning device 110 and allow the slippage of the bandolier 20 relative to the major knife hub 60 to reach a steady state before commanding another adjustment to the slippage. Such a dwell or sleep mode is desirable since the remote knife mechanism 10 may often process 1000-5000 pouches per minute. Without the dwell or sleep mode, the controller 201 may generate multiple adjustment commands before the impact of the first adjustment command is fully integrated into the bandolier cutting process.

Figure 11:
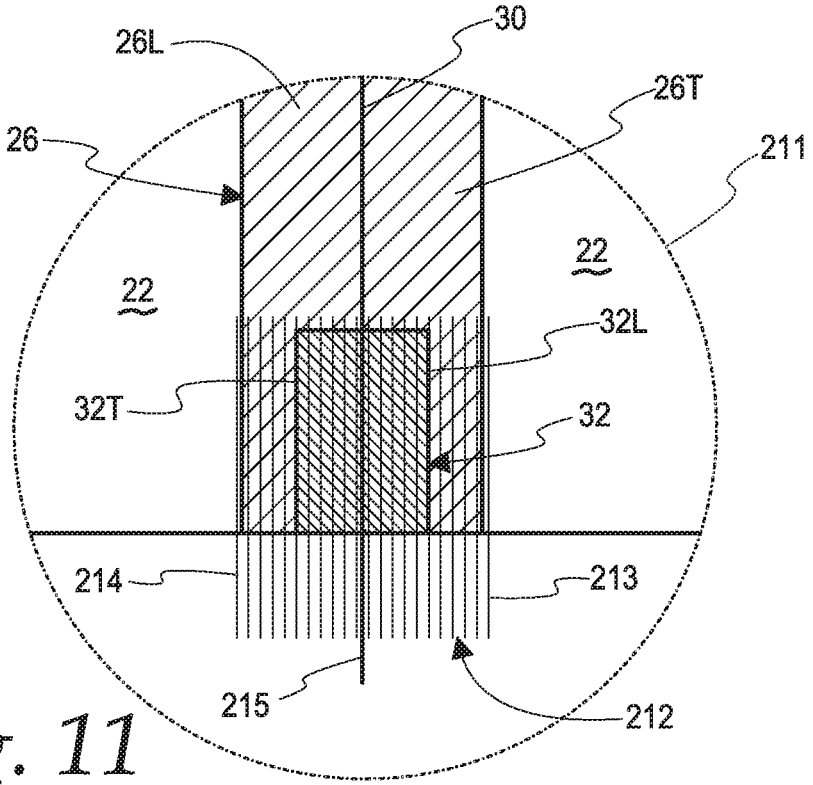
FIG. 11 depicts an enlarged top plan view of a portion of a bandolier including a registration mark centered upon an internal reference scale overlayed upon the registration mark.

Referring to FIG. 11, initiated by trigger disc 220 and trigger sensor 230, the optical image sensor 216 acquires an image of registration mark 32 relative to fixed incremental scale 212. In an example, the scale may extend ten (10) millimeters forward and ten (10) millimeters rearward of the center or midline 215 of the reference scale 212. In an embodiment, depending upon the setup process, the positional relationship of the midline 215 may correspond to the position of the trailing radial edge surface 66 of the operative blade 62 of the major knife hub 60 where formation of side edges 30 of pouches 22 occurs. Optical image sensor 216 obtains an image as each registration mark 32 is presented to the image acquisition field 211, and generates and delivers a numerical output to the controller 201. The numerical output may be in any form desired. In an embodiment, the numerical output may be expressed using a binary greycode.

In an embodiment, the position of the registration mark 32 relative to the reference scale 212 is generated for each image that is obtained, which is one image for each trigger of the optical image sensor 216 by the trigger sensor 230.

More specifically, the optical image sensor 216 superimposes each captured image upon the linearly graduated reference scale 212. In an embodiment, each of the lines of the reference scale 212 may be given a numerical indicator or numerical output. As depicted, the lines of the reference scale 212 may be 1 millimeter apart and the numerical indicator or numerical output of each line may correspond to the number of millimeters from the left hand edge of the reference scale. A graduation line on the reference scale 212 that is aligned with the measurement edge of the registration mark 32 is identified and designated as the numerical output of the optical image sensor 216. In one example, the measurement edge may be the leading edge 32L of the registration mark 32. In another example, the measurement edge may be the trailing edge 32T of the registration mark 32.

The optical image sensor 216 is operative to generate a numerical output indicative of the alignment of the registration mark 32 with the reference scale 212. In an embodiment, the controller 201 may utilize the numerical output from the optical image sensor 216 as the alignment input used to determine whether the registration mark 32 is sufficiently aligned with the desired or target position. In another embodiment, the controller 201 may utilize an average of numerical output data from the optical image sensor 216 as the alignment input.

In one example, the average may be determined based upon the numerical output from a predetermined number of optical measurement cycles. In another example, the average may be determined by using a decaying averaging process. To generate a decaying average, the numerical output from the current optical measurement cycle or image is given a first percentage weighting and the decaying average of the prior optical measurement cycles is given a second percentage weighting. In an embodiment, the first percentage is substantially less than the second percentage so that the decaying average of the prior optical measurement cycles is given substantially more weight that the numerical output from the current optical measurement cycle. As an example of the first percentage being substantially less than the second percentage, the numerical value of the current image may be given a ten-percent weight and decaying average of the prior images may be given a ninety-percent weight. Other ratios may be used. The new decaying average is equal to the sum of the weighted numerical input from the new or current image and the weighted decaying average of the prior images. By utilizing such a decaying average, an average of the numerical output may be rapidly generated and the desired weighting for the current image and the prior decaying average may be set to optimize the pouch manufacturing process.

Once the alignment input is determined (e.g., using the actual numerical output or an average numerical output of the optical image sensor 216), the controller 201 may determine an alignment difference between the alignment input and the target position. If the alignment difference is within the operating range, the remote cutting mechanism 10 may continue to be operated without a change to the bandolier feeding process. If the alignment difference is outside the operating range, the controller 201 can generate an adjustment command to implement a suitable adjustment of the slippage of the bandolier 20 relative to the major knife hub 60 and thus adjust the registration mark-knife relationship. In this regard, the output signal of controller 201 maintains the pneumatic pressure delivered to pneumatic actuators 95 and 116 by proportional pressure regulators 300 and 310. Should adjustment be required, the adjustment command can modify the pressure maintained by one or both regulators 300 and 310. Such a modification may correspond to the adjustment amount stored within the controller 201.

Adjustment of the position of the registration mark 32 relative to the reference scale 212 can involve actuation of the actuators 95 and 116 of the paddle tensioning device 90 and belt tensioning device 110 independently or in conjunction with each other. These devices have opposite effects on registration mark position. Increasing the magnitude of the radial force of the paddle tensioning device 90 will move the registration mark rearward relative to the feed direction of the bandolier 20. Increasing the radial force of belt tensioning device 110 will cause forward movement of registration mark 32 relative to the feed direction of the bandolier 20. In some embodiments, the effect of the force of paddle tensioning device 90 has the potential to make corrections of a larger magnitude in terms of the dimension of the resultant adjustment. Consequently, depending on the severity of the correction determined necessary, a combination of adjustments of both the paddle tensioning device 90 and belt tensioning device 110 may be employed.

Figure 2:
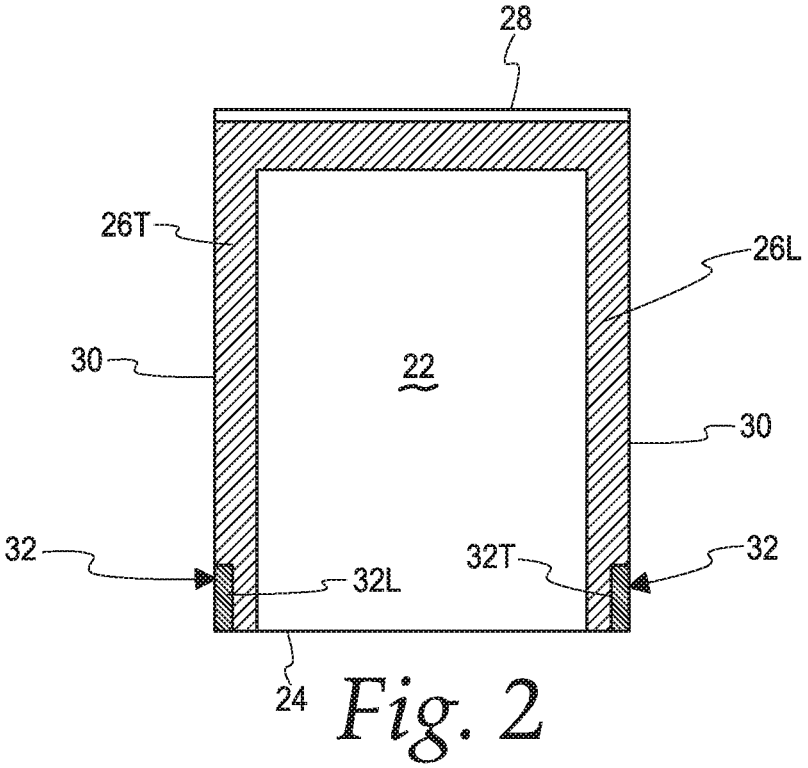
FIG. 2 depicts a schematic view of one of the pouches from the bandolier of FIG. 1.

FIG. 11 graphically illustrates an ideal image position of a registration mark 32 generated by the optical image sensor 216 superimposed on the fixed referenced scale 212. As illustrated, the registration mark 32 is positioned equidistant from the initial line or end 213 of the reference scale 212 and the final line or end 214 of the reference scale 212. The resultant pouch formed with such an alignment is illustrated in FIG. 2 and has side seam seals 26L and 26T of equal width. This result is achieved when the remote knife mechanism 10 is forming side edges 30 in the optimum position, bisecting the common side seal seam 26.

Figure 12:
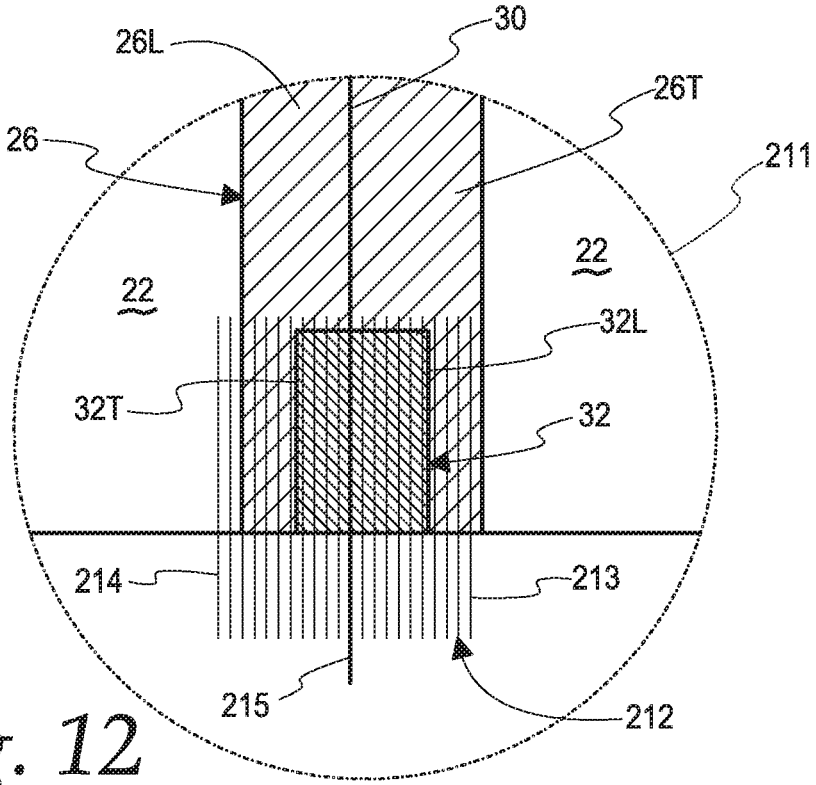
FIG. 12 depicts an enlarged top plan view similar to FIG. 11 but with the registration mark advanced relative to the reference scale.
Figure 13:
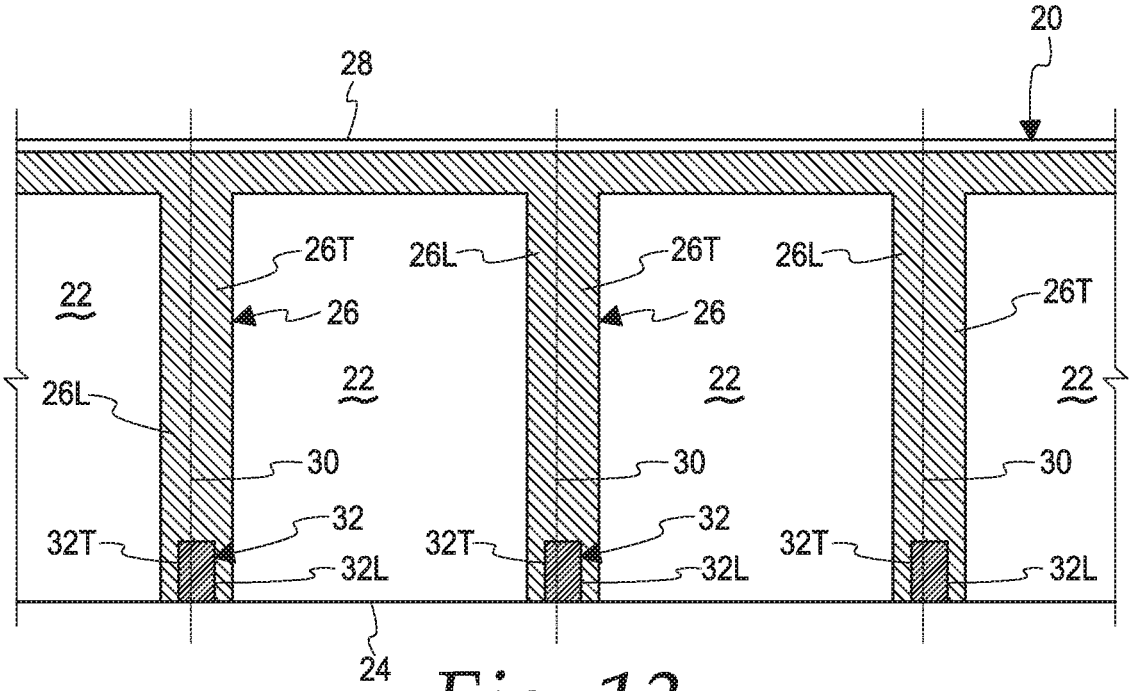
FIG. 13 depicts a schematic view of a portion of a bandolier of pouches with the registration marks advanced in a manner similar to FIG. 12.

FIG. 12 is a graphic representation illustrating an image position of registration mark 32 that is "advanced" relative to the reference scale 212. That is, the registration mark leading edge 32L is displaced forward, toward the initial line 213 and the trailing edge of the registration mark 32T is displaced forward, away from final line 214. This image is indicative of pouch 22 with a side seam seal 26L at its leading edge that is narrower than the side seam seal 26T at its trailing edge. A bandolier 20 of such pouches 22 is illustrated in FIG. 13.

Figure 14:
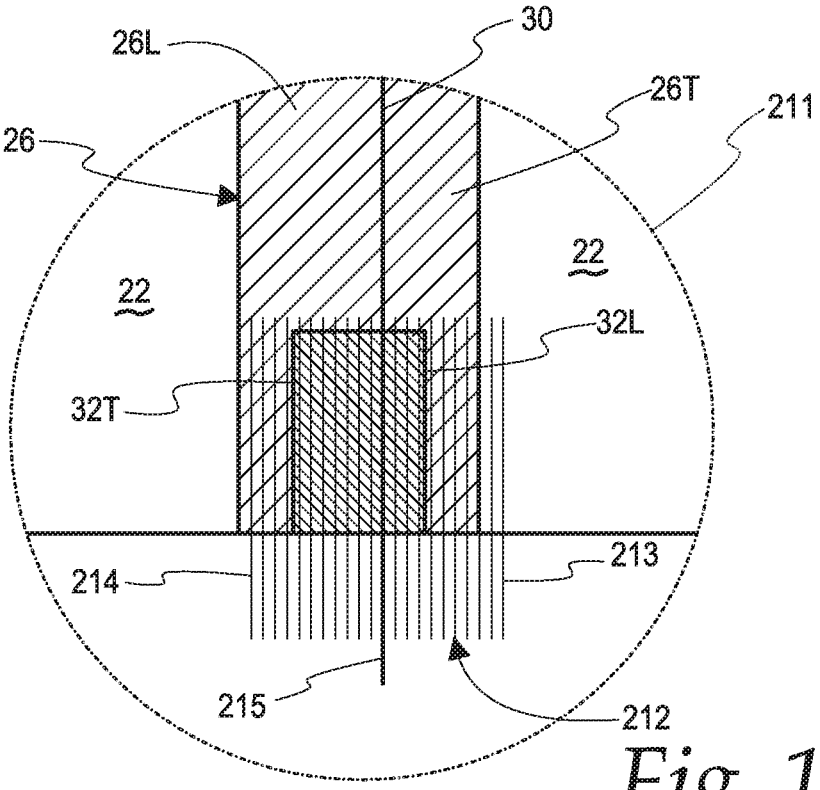
FIG. 14 depicts an enlarged top plan view similar to FIG. 11 but with the registration mark retarded relative to the reference scale.
Figure 15:
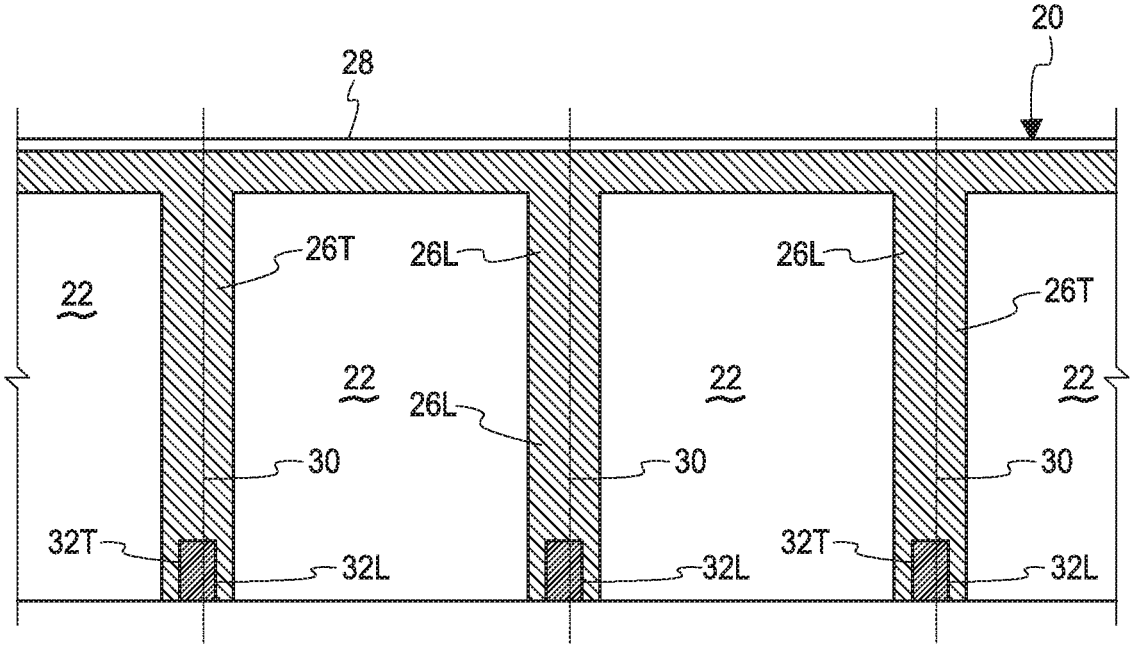
FIG. 15 depicts a schematic view of a portion of a bandolier of pouches with the registration marks retarded in a manner similar to FIG. 14.

FIG. 14 is a graphic representation illustrating an image position of registration mark 32 that is "retarded" relative to the reference scale 212. The leading edge 32L of the registration mark 32 is displaced rearward away from initial line 213 and the trailing edge 32T of the registration mark 32 is displaced toward the final line 214. This image is indicative of pouch 22 with a side seam seal 26L at its leading edge that is wider than the side seam seal 26T at its training edge. A bandolier 20 of such pouches 22 is illustrated in FIG. 15.

On recognition of either of the deviations described above, the controller 201 may generate an adjustment command to modify the signals to the proportional pressure regulators 300 and 310 so that they change the force applied by one or both actuators 95 and 116. For example, in the instance of the illustration of FIG. 12, output signals from controller 201 may increase the normal force upon the bandolier 20 exerted by paddle tensioning device 90 and/or reduce radial force upon the bandolier 20 exerted by belt tensioning device 110. In the example illustrated in FIG. 14, output signals from controller 201 may decrease the normal force upon the bandolier 20 exerted by the paddle-tensioning device 90 and/or increase the radial force upon the bandolier 20 exerted by the belt tensioning device 110.

Variations and modifications of the foregoing are within the scope of the present invention. It is understood that the invention disclosed and defined herein extends to all alternative combinations of two or more of the individual features mentioned, or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

The invention claimed is:

1. A system monitoring and controlling registration on a pouch separation knife machine, of a longitudinally extending bandolier of content containing pouches spaced apart by transverse seal seams moving along a feed path, each pouch having a measurement reference, the separation knife machine comprising:

a knife mechanism comprising a major knife hub, mounted along the feed path and having a plurality of spaced apart blades having an outer edge, a minor knife hub having at least one blade, said minor knife hub cooperating with said major knife hub at a cutting location to sever individual pouches from the bandolier at the seal seams, and a drive mechanism, driving said major knife hub and minor knife hub in a synchronous manner;

a friction drag mechanism, to engage the bandolier along the feed path and maintain driving engagement between the major knife hub and the bandolier;

a friction drag adjustment mechanism to adjust the longitudinal position of the bandolier relative to the major knife hub;

said system comprising:

an optical image sensor having an internal reference scale indicative of the location of synchronous cooperation between said blades of said major knife hub and minor knife hub;

a position recognition mechanism to actuate the optical image sensor to capture an image of said measurement reference of pouches moving along the feed path when said blades are at said position of synchronous cooperation;

said optical image sensor, operative to superimpose each captured image upon said internal reference scale and acquire an image of said measurement reference relative to said internal reference scale and to generate variable numeric output signals indicative of a position relative to the internal reference scale of the measurement references of pouches moving along the feed path; and a controller configured to:

store a target value for the numeric output signal indicative of a desired cutting location within a pouch seal seam;

store an operating range for the target value;

receive said numeric output signals from the optical image sensor;

determine a position of the measurement reference relative to the internal reference scale based upon the numeric output signal of said optical image sensor;

determine an alignment input based upon the position of the measurement reference relative to the internal reference scale;

determine an alignment difference between the target value and the alignment input; and generate an adjustment command to the friction drag adjustment mechanism to change the position of the bandolier along the feed path after the alignment difference exceeds the operating range for the target position.

2. The system of claim 1, wherein the major knife hub and minor knife hub of the knife mechanism are rotatable hubs, and the blades of each knife hub are radial.

3. The system of claim 2, wherein each radial blade of the major knife hub of the knife machine has a trailing edge that cooperates with a cutting edge of a radial blade of the minor knife hub of the knife machine to sever a pouch from the moving bandolier at the cutting location.

4. The system of claim 1, said position recognition mechanism is operative to cause the optical image sensor to capture an image of each measurement reference, based on the position of the cooperating knife blades.

5. The system of claim 1, wherein said optical image sensor includes an image acquisition field disposed along the feed path upstream from the cutting location.

6. The system of claim 1, wherein the internal reference scale includes a plurality of graduation lines, and each graduation line having a numerical indicator.

7. The system of claim 6, wherein the variable numeric output signals from the optical image sensor includes a number corresponding to the numerical indicator aligned with the measurement reference.

8. The system of claim 1, wherein the measurement reference comprises a mark aligned with a common seal seam between adjacent pouches of the bandolier.

9. The system of claim 1, wherein the measurement reference comprises a mark spaced from a common seal seam between adjacent pouches of the bandolier.

10. A method of monitoring and controlling registration on a pouch separation knife machine, of a longitudinally extending bandolier of content containing pouches spaced apart by transverse seal seams moving along a feed path, each pouch having a measurement reference, the separation knife machine, comprising:

a knife mechanism comprising a major knife hub, mounted along the feed path and having a plurality of spaced apart blades having an outer edge, a minor knife hub having at least one blade, said minor knife hub cooperating with said major knife hub at a cutting location to sever individual pouches from the bandolier at the seal seams, and a drive mechanism, driving said major knife hub and minor knife hub in a synchronous manner;

a friction drag mechanism, to engage the bandolier along the feed path and maintain driving engagement between the major knife hub and the bandolier;

a friction drag adjustment mechanism to adjust the longitudinal position of the bandolier relative to the major knife hub;

a position recognition mechanism to actuate the optical image sensor to capture an image of said measurement reference of pouches moving along the feed path when said blades are at said position of synchronous cooperation;

an optical image sensor having an internal reference scale indicative of the location of synchronous cooperation between said blades of said major knife hub and minor knife hub;

said optical image sensor, operative to superimpose each captured image upon said internal reference scale and acquire an image of said measurement reference relative to said internal reference scale and to generate variable numeric output signals indicative of a position relative to the internal reference scale of the measurement references of pouches moving along the feed path; and and a controller;

said method comprising:

maintaining driving engagement between the major knife hub and the bandolier along the feed path;

store a target value for the numeric output signal indicative of a desired cutting location within a pouch seal seam;

store an operating range for the target value;

receive said numeric output signals from the optical image sensor;

determine a position of the measurement reference relative to the internal reference scale based upon the numeric output signal of said optical image sensor;

determine an alignment input based upon the position of the measurement reference relative to the internal reference scale;

determine an alignment difference between the target value and the alignment input; and generating an adjustment command to the friction drag adjustment mechanism to adjust a position of the bandolier along the feed path after the alignment difference exceeds the operating range for the target position.

11. The method of claim 10, wherein said position recognition mechanism is operative to cause the optical image sensor to capture an image of each measurement reference, based on the position of the cooperating knife blades.

12. The method of claim 10, wherein said optical image sensor includes an image acquisition field disposed along the feed path upstream from the cutting location.

13. The method of claim 10, wherein the internal reference scale includes a plurality of graduation lines, and each graduation line having a numerical indicator.

14. The method of claim 13, wherein the variable numeric output signals from the optical image sensor includes a number corresponding to the numerical indicator aligned with the measurement reference.

* * * * *